US011642758B2

(12) United States Patent
Xu et al.

(10) Patent No.: US 11,642,758 B2
(45) Date of Patent: May 9, 2023

(54) NONWOVEN ABRASIVE BELT WITH FLEXIBLE JOINT

(71) Applicants: SAINT-GOBAIN ABRASIVES, INC, Worcester, MA (US); SAINT-GOBAIN ABRASIFS, Conflans-Sainte-Honorine (FR)

(72) Inventors: Zhong Xu, Holden, MA (US); Sathanjheri Ravishankar, Shrewsbury, MA (US); William C. Rice, Medway, MA (US); Fernando J. Ramirez, Reynosa (MX); Jose J. Rangel, Hico, TX (US); Shyiguei Hsu, Plano, TX (US); Ying Cai, Berwyn, PA (US); Jeremy B. Spencer, DeLeon, TX (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 946 days.

(21) Appl. No.: 16/521,858

(22) Filed: Jul. 25, 2019

(65) Prior Publication Data

US 2020/0030941 A1 Jan. 30, 2020

Related U.S. Application Data

(60) Provisional application No. 62/703,404, filed on Jul. 25, 2018.

(51) Int. Cl.

| | |
|---|---|
| ***B24D 11/06*** | (2006.01) |
| *B24D 3/00* | (2006.01) |
| *B24D 11/00* | (2006.01) |
| *B24D 18/00* | (2006.01) |
| *B24B 1/00* | (2006.01) |
| *C09K 3/14* | (2006.01) |

(52) U.S. Cl.
CPC ..... *B24D 11/06* (2013.01)

(58) Field of Classification Search
CPC ..... B24D 3/00; B24D 11/00; B24D 18/00; B24D 11/06; B24B 1/00; C09K 3/14
USPC ..... 51/293, 295, 298, 307; 451/531
See application file for complete search history.

(56) References Cited

U.S. PATENT DOCUMENTS

| | | | | |
|---|---|---|---|---|
| 2,733,181 A | | 1/1956 | Riedesel | |
| 3,154,897 A | | 11/1964 | Howard | |
| 3,427,765 A | * | 2/1969 | McGarvey | B24D 11/06 451/531 |
| 3,729,873 A | | 5/1973 | Sandell | |

(Continued)

FOREIGN PATENT DOCUMENTS

| | | |
|---|---|---|
| CN | 1073388 A | 6/1993 |
| CN | 1111558 A | 11/1995 |

(Continued)

OTHER PUBLICATIONS

International Search Report and Written Opinion for PCT/US2019/043366, dated Nov. 8, 2019, 11 pages.

*Primary Examiner* — James E McDonough
(74) *Attorney, Agent, or Firm* — Abel Schillinger, LLP; Arpan Ghosh

(57) ABSTRACT

This disclosure, in general, relates to nonwoven abrasive belts including flexible butt joints and methods of making and using such belts and joints.

19 Claims, 5 Drawing Sheets

(56) References Cited

U.S. PATENT DOCUMENTS

| | | | | | |
|---|---|---|---|---|---|
| 4,194,618 | A | * | 3/1980 | Malloy | C08L 25/16 156/289 |
| 4,215,516 | A | * | 8/1980 | Huschle | F16G 3/10 156/304.3 |
| 5,305,560 | A | | 4/1994 | Roelofs | |
| 5,341,609 | A | | 8/1994 | Gorsuch et al. | |
| 5,482,756 | A | * | 1/1996 | Berger | B24D 11/006 428/36.1 |
| 5,489,235 | A | | 2/1996 | Gagliardi et al. | |
| 5,575,873 | A | * | 11/1996 | Pieper | B24D 11/06 156/304.6 |
| 5,840,141 | A | | 11/1998 | Korbel | |
| 2002/0058468 | A1 | | 5/2002 | Eppert, Jr. et al. | |
| 2008/0295947 | A1 | | 12/2008 | Bourbeau et al. | |
| 2012/0171459 | A1 | | 7/2012 | Herbert | |
| 2016/0229032 | A1 | * | 8/2016 | Moren | B24D 11/02 |

FOREIGN PATENT DOCUMENTS

| | | | |
|---|---|---|---|
| CN | 1125413 | A | 6/1996 |
| CN | 1476369 | A | 2/2004 |
| EP | 1098736 | B1 | 11/2002 |
| JP | H05-229071 | A | 9/1993 |
| JP | 2012-076174 | A | 4/2012 |
| JP | 2018-511489 | A | 4/2018 |
| WO | 9312911 | A1 | 7/1993 |
| WO | 9500294 | A1 | 1/1995 |
| WO | 9810896 | A1 | 3/1998 |
| WO | 0198032 | A1 | 2/2004 |
| WO | 2016167967 | A1 | 10/2016 |

* cited by examiner

NONWOVEN ABRASIVE BELT WITH FLEXIBLE JOINT

CROSS-REFERENCE TO RELATED APPLICATION

This application claims priority under 35 U.S.C. § 119(e) to U.S. Provisional Application No. 62/703,404, entitled "NONWOVEN ABRASIVE BELT WITH FLEXIBLE JOINT," by Zhong X U et al., filed Jul. 25, 2018, which is assigned to the current assignee hereof and incorporated by reference herein in its entirety.

FIELD OF THE DISCLOSURE

This disclosure, in general, relates to nonwoven abrasive belts including flexible butt joints and methods of making and using such belts and joints.

BACKGROUND

Nonwoven abrasive belts and other nonwoven loop abrasive articles are used in a variety of industries. For instance, abrasive belts are used in various types of belt sanders, including in particular, file belt sanders, and are used to abrade various types of workpiece materials, such as wood, stone, ceramics, and metals to accomplish grinding as well as fine finishing and polishing of articles.

To form nonwoven abrasive belts, conventionally, the ends of the nonwoven abrasive substrate are joined together to form a joint and are secured together at the joint with a tape or patch and typically include an adhesive. Such nonwoven belts are subject to continual thermal and mechanical stresses (e.g., cyclic tensile and centrifugal stress loading) due to constant flexing as the belt rotates around tool guide pulleys as well as abrasive stresses when in contact with the workpiece. Achieving adequate abrasive performance and avoiding premature belt failure is difficult.

Although various efforts have been made in the past to try to improve nonwoven abrasive belt technology, all have suffered from various drawbacks. Therefore, there continues to be a demand for new and improved nonwoven abrasive belts.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

Figure 1:
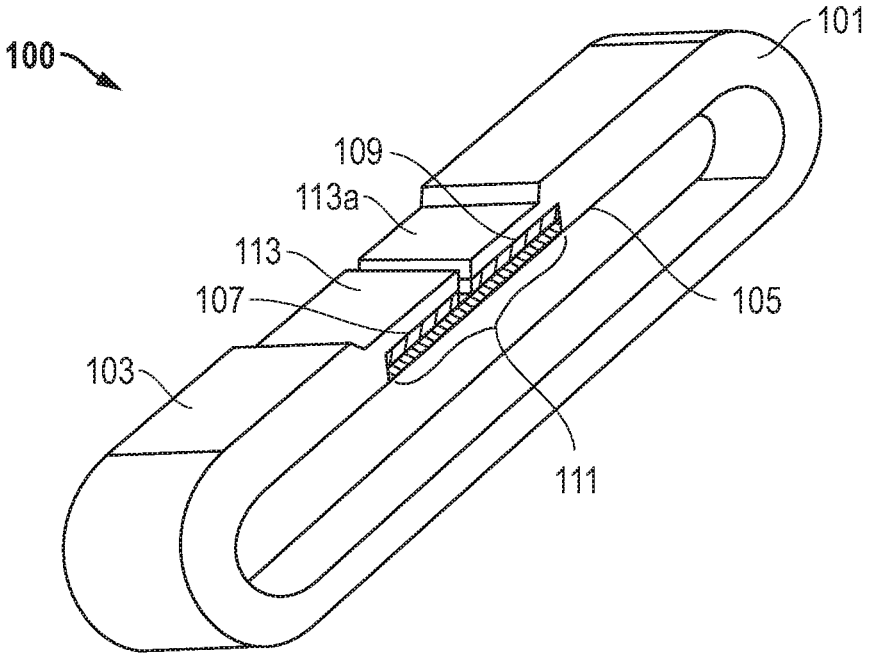
FIG. 1 shows an illustration of a nonwoven abrasive belt embodiment including a flexible butt joint.

The following description, in combination with the figures, is provided to assist in understanding the teachings disclosed herein. The following discussion will focus on specific implementations and embodiments of the teachings. This discussion is provided to assist in describing the teachings and should not be interpreted as a limitation on the scope or applicability of the teachings.

The term "averaged," when referring to a value, is intended to mean an average, a geometric mean, or a median value. As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but can include other features not expressly listed or inherent to such process, method, article, or apparatus. As used herein, the phrase "consists essentially of" or "consisting essentially of" means that the subject that the phrase describes does not include any other components that substantially affect the property of the subject.

Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

Further, references to values stated in ranges include each and every value within that range. When the terms "about" or "approximately" precede a numerical value, such as when describing a numerical range, it is intended that the exact numerical value is also included. For example, a numerical range beginning at "about 25" is intended to also include a range that begins at exactly 25. Moreover, it will be appreciated that references to values stated as "at least about," "greater than," "less than," or "not greater than" can include a range of any minimum or maximum value noted therein.

As used herein, the phrase "average particle diameter" can be reference to an average, mean, or median particle diameter, also commonly referred to in the art as D50.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and can be found in textbooks and other sources within the coated abrasive arts.

FIG. 1 shows an embodiment of a nonwoven abrasive belt 100 comprising a nonwoven abrasive web (101) having a first major surface (103) (also referred to herein as a "first side", a "top surface", or a "working surface"), a second major surface (105) (also referred to herein as a "second side", a "bottom surface", or a "non-working surface), a first end (107), and a second end (109); wherein the first end and the second end are adhered together by a butt joint (111) wherein, a portion of the first major surface of the first end includes a skived portion (113) (also referred to herein as a "top skived" portion) and/or a portion of the first major surface of the second end includes a skived portion (113*a*). In an embodiment, a portion of the first major surface (103) of the first end (107) and a portion of the first major surface (103) of the second end (109) can both include a skived portion (113, 113*a*). Skiving of the first major surface (103) is also referred to herein as "top skiving" of the abrasive web.

Figure 2:
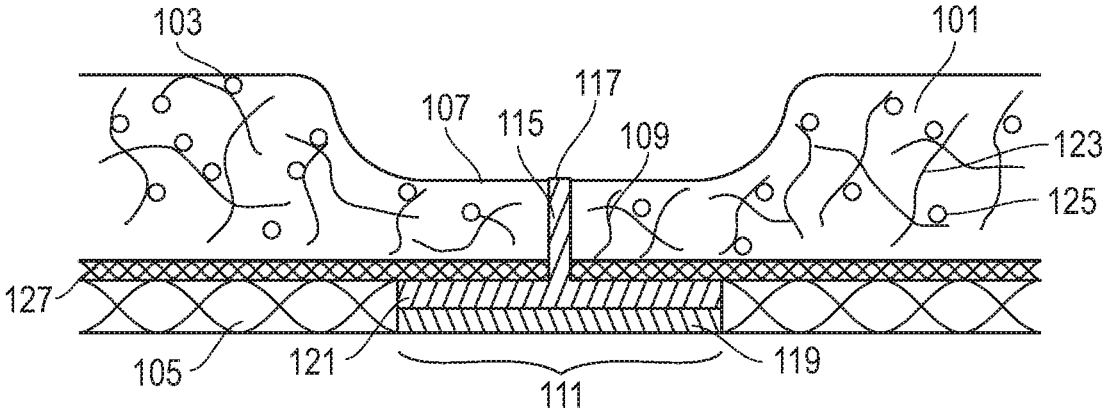
FIG. 2 shows an illustration of a close up view of the nonwoven abrasive belt embodiment of FIG. 1 including a flexible butt joint.

FIG. 2 shows a close up of the butt joint portion of the nonwoven abrasive belt embodiment of FIG. 1. The butt joint 111 comprises the first end 107 and the second end 109 of the nonwoven abrasive web 101 that abut each other, an adhesive polymeric composition 115 disposed in a seam 117 between the first end 107 and the second end 109, a patch 119 disposed on the second major surface 105 of the nonwoven abrasive web opposite where the first end 107 and the second end 109 abut each other, and a layer of adhesive polymeric composition 121 disposed between the patch 119 and the second major surface 105. In an embodiment, the adhesive polymeric composition 115 disposed in the seam can be separate or integral with the adhesive polymeric composition 121 that adheres the patch to the second side of the nonwoven abrasive web. The adhesive polymeric composition 115 can be the same as, or different than, the adhesive polymeric composition 121. The nonwoven abrasive web comprises a nonwoven web of fibers 123, abrasive particles 125, and a polymeric binder composition (not shown), wherein the abrasive particles are adhered to the fibers with the polymeric binder composition. In an embodiment, the nonwoven abrasive we can include a reinforcing scrim material 127.

Figure 3:
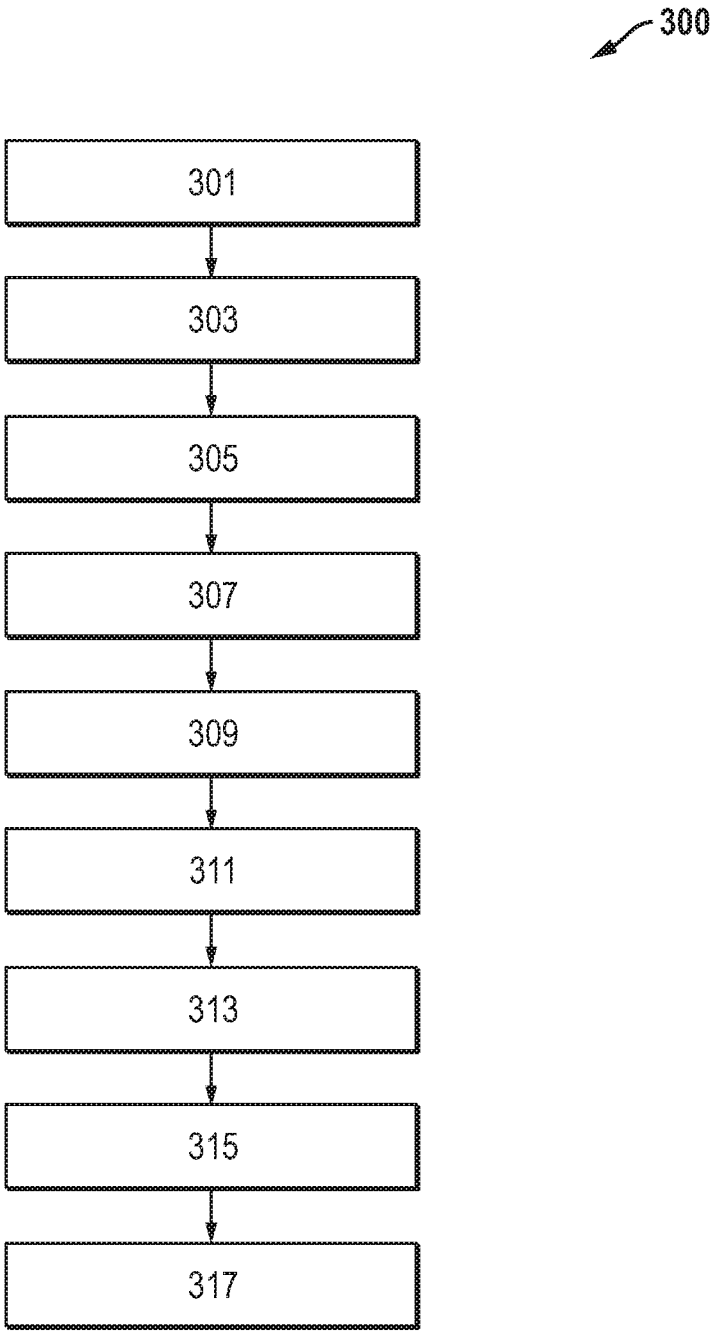
FIG. 3 shows process flow diagram of an embodiment of a method of making a nonwoven abrasive belt embodiment including a flexible butt joint.

FIG. 3 shows a process flow diagram of an embodiment of a method 300 of making a nonwoven abrasive belt. In step 301, skiving off a portion (i.e., a thickness) from a first major surface of a first end of a nonwoven web to form a first top skived portion occurs. In step 303, skiving off a portion (i.e., a thickness) from a first major surface of a second end of a nonwoven web to form a second top skived portion occurs. In an embodiment, at least 20% to not greater than 50% of the thickness of the nonwoven abrasive belt can be skived off of the first major surface at either the first or second end or at both the first and second end of the nonwoven abrasive web. In step 305, disposing a polymeric adhesive composition on a second major surface of the first end of the nonwoven web opposite the first top skived portion occurs. In step 307, disposing a polymeric adhesive composition on a second major surface of the second end of the nonwoven web opposite the second top skived portion occurs. In an embodiment, the steps 305 and 307 can occur simultaneously. In step 309, bringing together the first end and the second end of the nonwoven web occurs so that the first end and the second end abut to form a butt joint. In an embodiment, the butt joint can have a seam. In an embodiment, the first top skived portion and the second top skived portion can form a channel along the first major surface of the nonwoven abrasive web when the first end and the second end abut (i.e., are brought together). In step 311, disposing a patch onto the polymeric adhesive composition located on the second major surface occurs so that the patch underlies the butt joint opposite the channel. In step 313, curing the polymeric adhesive composition occurs. In an embodiment, curing the polymeric adhesive composition can occur by compressing and heating the butt joint at a desired pressure and temperature. In step 315, disposing a polymeric adhesive composition into the seam of the butt joint occurs. In step 317, curing the polymeric adhesive composition in the seam occurs to form the nonwoven abrasive belt. In an embodiment, curing of the polymeric adhesive composition in the seam can occur by compressing and heating the butt joint at a desired pressure and temperature.

In another embodiment, the method of making can further comprise, prior to bringing the first end and the second end together, skiving off a portion (i.e., a thickness) from the second major surface of the first end of the nonwoven web to form a first bottom skived portion and skiving off a portion (i.e., a thickness) from the second surface of the second end of the nonwoven web to form a second bottom skived portion. In an embodiment, not greater than 20% of the thickness of the nonwoven abrasive belt can be skived off of the second major surface of the first and/or second end of the nonwoven abrasive web. In an embodiment, the first bottom skived portion and the second bottom skived portion can form a channel along the second major surface of the nonwoven abrasive web when the first end and the second end abut (i.e., are brought together). In an embodiment, the depth of the channel along the second major surface can be substantially equal to the thickness of the patch. In an embodiment, as a variation of step 311, disposing the patch onto the polymeric adhesive composition located on the second major surface occurs so that the patch underlies the butt joint opposite the channel.

Joint Stiffness

The butt joint can possess a beneficial joint stiffness that provides adequate flexibility while retaining desired strength. In an embodiment, the butt joint can comprise a stiffness of not greater than 1000 $N \cdot mm^2$, such as not greater than 900 $N \cdot mm^2$, not greater than 800 $N \cdot mm^2$, or not greater than 700 $N \cdot mm^2$. In an embodiment, the butt joint can comprise a stiffness of at least 300 $N \cdot mm^2$, such as at least 400 $N \cdot mm^2$, at least 500 $N \cdot mm^2$, or at least 550 $N \cdot mm^2$. It will be appreciated that the butt joint stiffness can be in an amount within a range of any of the maximum or minimum values noted above. In an embodiment, the butt joint stiffness can be in a range of 300 $N \cdot mm^2$ to 1000 $N \cdot mm^2$, such as 450 $N \cdot mm^2$ to 850 $N \cdot mm^2$, or 550 $N \cdot mm^2$ to 700 $N \cdot mm^2$.

Belt Lifetime Performance Rating

The nonwoven abrasive belt can possess a beneficial lifetime abrasive performance rating. In an embodiment, the nonwoven abrasive belt can comprise a normalized lifetime abrasive performance rating, such as a normalized average material removal rate of at least a specific minimum amount of reference workpiece material, such as grams of material removed from a stainless steel workpiece for at least a minimum amount of time, such as at least a rating of grams of material per minute per inch of belt for at least 180 seconds. In an embodiment, the nonwoven abrasive belt can comprise a beneficial lifetime abrasive performance rating, such as a normalized lifetime abrasive performance rating for a single workpiece reference material, multiple workpiece reference materials, or a combination of different reference workpiece materials. In a specific embodiment, the nonwoven abrasive belt can have a beneficial abrasive performance rating on stainless steel, carbon steel, Inconel, or a combination thereof.

Butt Joint

The butt joint can have particular beneficial structural features or dimensions. In an embodiment, the butt joint can comprise a beneficial average thickness, such as measured at a central location (121) of the nonwoven abrasive belt located approximately equidistant from the ends (107, 109). In an embodiment, the butt joint can comprise an average thickness that is not less than 50% of the average thickness of the nonwoven abrasive belt, such as not less than 52%, not less than 54%, or not less than 56% of the average thickness of the nonwoven abrasive belt. In an embodiment, the butt joint can comprise an average thickness that is not greater than 80% of the average thickness of the nonwoven abrasive belt, such as not greater than 75%, not greater than 70%, or not greater than 65% of the average thickness of the nonwoven abrasive belt. It will be appreciated that the butt joint thickness can be in any amount within a range of any of the maximum or minimum values noted above. In an embodiment, the butt joint can comprise an average thickness that is not less than 50% and not greater than 80% of the average thickness of the nonwoven abrasive belt.

In an embodiment, the butt joint can comprise a beneficial length as compared to the total length of the nonwoven abrasive belt. In an embodiment, the butt joint can comprise a length that is not less than 5% of the length of the nonwoven abrasive belt, such as not less than 6%, not less than 7%, or not less than 8% of the length of the nonwoven abrasive belt. In an embodiment, the butt joint can comprise a length that is not greater than 15% of the length of the nonwoven abrasive belt, such as not greater than 14%, not greater than 13%, not greater than 12%, or not greater than 11% of the length of the nonwoven abrasive belt. It will be appreciated that the butt joint length can be in any amount within a range of any of the maximum or minimum values noted above. In an embodiment, the butt joint can comprise a length that is not less than 5% and not greater than 15% of the length of the nonwoven abrasive belt.

Joint Adhesive

In an embodiment, the total amount of adhesive polymeric composition comprising the butt joint (i.e., the amount of adhesive polymeric composition disposed within the seam plus the amount of adhesive polymeric composition that adheres the patch to the second major surface of the nonwoven web) can beneficially vary in amount. In an embodiment, the nonwoven abrasive belt has a length of 18 inches, and the butt joint can comprises a total amount of adhesive polymeric composition of not less than 0.2 wt % of the total weight of the nonwoven abrasive belt, such as not less than 0.45 wt %, such as not less than 0.55 wt %, not less than 0.70 wt %, not less than 0.73 wt %, not less than 0.82 wt %, or not less than 0.91 wt %. In an embodiment, the nonwoven abrasive belt has a length of 18 inches, and the butt joint can comprises a total amount of adhesive polymeric composition of not greater than 1.95%, such as not greater than 1.82 wt %, not greater than 1.73 wt %, not greater than 1.64 wt %, not greater than 1.55 wt %, not greater than 1.45 wt %, or not greater than 1.36 wt %. It will be appreciated that the total amount of adhesive polymeric composition comprising the butt joint can be in any amount within a range of any of the maximum or minimum values noted above. In an embodiment, the nonwoven abrasive belt has a length of 18 inches, and the total amount of adhesive polymeric composition comprising the butt joint can comprise not less than 0.45 wt % to not greater than 1.82 wt % of the weight of the nonwoven abrasive belt. For example, in an embodiment, the nonwoven abrasive belt has a length of 18 inches and a weight of 220 g, and the butt joint comprises a total amount of adhesive polymeric composition between 1 gram and 4 grams.

Alternately, the amount of total adhesive polymeric composition can be expressed as a fixed amount. In an embodiment, the nonwoven abrasive belt has a width of 0.5 inches, and the butt joint can comprises a total amount of adhesive polymeric composition of not less than 0.06 g, such as not less than 0.07 g, not less than 0.08 g, not less than 0.09 g, not less than 0.1 g, or not less than 0.12 g. In an embodiment, the nonwoven abrasive belt has a width of 0.5 inches, and the butt joint can comprise a total amount of adhesive polymeric composition of not greater than 0.24 g, such as not greater than 0.22 g, not greater than 0.21 g, not greater than 0.20 g, not greater than 0.19 g, or not greater than 0.18 g. It will be appreciated that the total amount of adhesive polymeric composition comprising the butt joint can be in any amount within a range of any of the maximum or minimum values noted above. In an embodiment, the nonwoven abrasive belt has a width of 0.5 inches, and the total amount of adhesive polymeric composition comprising the butt joint can comprise not less than 0.06 g to not greater than 0.24 g.

In another embodiment, the nonwoven abrasive belt has a width of 8.5 inches, and the butt joint can comprises a total amount of adhesive polymeric composition of not less than 1 g, such as not less than 1.2 g, not less than 1.4 g, not less than 1.6 g, not less than 1.8 g, or not less than 2 g. In an embodiment, the nonwoven abrasive belt has a width of 8.5 inches, and the butt joint can comprise a total amount of adhesive polymeric composition of not greater than 4 g, such as not greater than 3.8 g, not greater than 3.6 g, not greater than 3.4 g, not greater than 3.2 g, or not greater than 3 g. It will be appreciated that the total amount of adhesive polymeric composition comprising the butt joint can be in any amount within a range of any of the maximum or minimum values noted above. In an embodiment, the nonwoven abrasive belt has a width of 8.5 inches, and the total amount of adhesive polymeric composition comprising the butt joint can comprise not less than 1 g to not greater than 4 g.

The total amount of the adhesive polymeric resin comprising the butt joint and the amount of the nonwoven abrasive web can be present in a beneficial ratio (adhesive: web). In an embodiment, the nonwoven abrasive belt has a length of 18 inches, and the total amount (i.e., weight) of the adhesive polymeric resin and the amount of the nonwoven abrasive web (i.e., weight) can be present in a ratio (total amount of adhesive:amount of nonwoven abrasive web) of not less than 1:200 to not greater than 1:50.

The adhesive polymeric composition can comprise a beneficial storage modulus as measured at a particular temperature. In an embodiment, the adhesive polymeric composition can comprises a storage modulus of at least 6.5 MPa at a temperature of 150° C., such as at least 6.7 MPa, at least 6.9 MPa, at least 7.1 MPa, at least 7.3 MPa, at least 7.5 MPa, at least 7.7 MPa, at least 7.9 MPa, or at least 8.0 MPa at a temperature of 150° C. In an embodiment, the adhesive polymeric composition can comprises a storage modulus of not greater than 9.9 MPa at a temperature of 150° C., such as not greater than 9.7 MPa, not greater than 9.5 MPa, not greater than 9.3 MPa, not greater than 9.1 MPa, not greater than 8.9 MPa, not greater than 8.7 MPa, not greater than 8.5 MPa, not greater than 8.3 MPa, or not greater than 8.1 MPa at a temperature of 150° C. It will be appreciated that the storage modulus can be in any amount within a range of any of the maximum or minimum values noted above.

The adhesive polymeric composition can comprise a polyurethane polymer or combination of polyurethane polymers.

Butt Joint Patch

The nonwoven abrasive belt can comprise a patch (also known in the art as a "joint patch" or "joint tape"). In an embodiment, the patch can comprise a synthetic fabric, a polymeric film, or a combination thereof Nonwoven Web The nonwoven abrasive belt comprises a nonwoven abrasive web. The nonwoven web can comprise a beneficial fabric weight. In an embodiment, an average weight of the nonwoven web can be not less than 180 g/m$^2$ ("GSM"), such as not less than 185 g/m$^2$, not less than 190 g/m$^2$, not less than 195 g/m$^2$, or not less than 200 g/m$^2$. In an embodiment, an average weight of the nonwoven web can be not greater than 250 g/m$^2$ ("GSM"), such as not greater than 245 g/m$^2$, not greater than 240 g/m$^2$, not greater than 235 g/m$^2$, or not greater than 230 g/m$^2$. It will be appreciated that the average weight of the nonwoven web can be in any amount within a range of any of the maximum or minimum values noted above. In an embodiment, the average weight of the nonwoven web can comprise not less than 185 g/m$^2$ to not greater than 250 g/m$^2$.

In an embodiment, the nonwoven web can comprise natural fibers, synthetic fibers, or a combination thereof. In a specific embodiment, the nonwoven web can comprise polyamide fibers (e.g., nylon fibers).

Abrasive Particles

The nonwoven abrasive belt can comprise abrasive particles in a beneficial amount. In an embodiment, an average weight of abrasive particles can be not less than 400 g/m$^2$ ("GSM"), such as not less than 500 g/m$^2$, not less than 600 g/m$^2$, not less than 700 g/m$^2$, or not less than 800 g/m$^2$. In an embodiment, an average weight of abrasive particles can be not greater than 1400 g/m$^2$ ("GSM"), such as not greater than 1300 g/m$^2$, not greater than 1200 g/m$^2$, not greater than 1100 g/m$^2$, or not greater than 1000 g/m$^2$. It will be appreciated that the average weight of abrasive particles can be in any amount within a range of any of the maximum or minimum values noted above. In an embodiment, the average weight of abrasive particles can comprise not less than 400 g/m$^2$ to not greater than 1400 g/m$^2$.

Abrasive particles can comprise aluminum oxide (including fused aluminum oxide, such as friable and semi-friable aluminum oxide, as well as ceramic aluminum oxide, such as sol-gel alumina, whether doped or undoped), zirconia, silicon carbide, diamond, blends thereof, and combinations thereof.

Abrasive particles can have an average particles size comprising 50 μm to 1000 μm.

Polymeric Binder

The nonwoven abrasive belt can comprise a polymeric binder composition in a beneficial amount. In an embodiment, an average weight of polymeric binder composition can be not less than 500 g/m$^2$ ("GSM"), such as not less than 550 g/m$^2$, not less than 600 g/m$^2$, or not less than 650 g/m$^2$. In an embodiment, an average weight of polymeric binder composition can be not greater than 900 g/m$^2$ ("GSM"), such as not greater than 850 g/m$^2$, not greater than 800 g/m$^2$, or not greater than 750 g/m$^2$. It will be appreciated that the average weight of polymeric binder composition can be in any amount within a range of any of the maximum or minimum values noted above. In an embodiment, the average weight of polymeric binder composition can comprise not less than 500 g/m$^2$ to not greater than 900 g/m$^2$.

The polymeric binder composition can comprise a polymeric resin or combination of polymeric resins, one or more fillers (e.g., talc, lithium stearate), one or more rheology modifiers (e.g. fumed silica), one or more colorants, and combinations thereof. In an embodiment, the polymeric binder composition can comprise a polyurethane resin, a filler, a rheology modifier, a colorant, and combinations thereof.

EMBODIMENTS

Embodiment 1

A nonwoven abrasive belt comprising a nonwoven abrasive web having a first major surface, a second major surface, a first end, and a second end wherein the first end and the second end are adhered together by a butt joint, and wherein a portion of the first major surface of the first end or a portion of the first major surface of the second end includes a skived portion.

Embodiment 2

The nonwoven abrasive belt of embodiment 1, wherein a portion of the first major surface of the first end and a portion of the first major surface of the second end includes a skived portion.

Embodiment 3

The nonwoven abrasive belt of embodiment 1, wherein the butt joint comprises a stiffness of not greater than 1000 N·mm$^2$, such as not greater than 900 N·mm$^2$, not greater than 800 N·mm$^2$, or not greater than 700 N·mm$^2$.

Embodiment 4

The nonwoven abrasive belt of embodiment 1, wherein the butt joint comprises a stiffness of at least 300 N·mm$^2$, such as at least 400 N·mm$^2$, at least 500 N·mm$^2$, or at least 550 N·mm$^2$.

Embodiment 5

The nonwoven abrasive belt of embodiment 1, wherein the nonwoven abrasive belt has a length of 18 inches, and the butt joint comprises an adhesive polymeric composition in an amount of not less than 0.2 wt % and not greater than 1.82 wt % of the total weight of the nonwoven abrasive belt.

Embodiment 6

The nonwoven abrasive belt of embodiment 1, wherein the butt joint comprises an adhesive polymeric composition, wherein the amount of the adhesive polymeric resin and the amount of the nonwoven abrasive web are present in a ratio (adhesive:web) of not less than 1:200 to greater than 1:50.

Embodiment 7

The nonwoven abrasive belt of embodiment 1, wherein the butt joint comprises an adhesive polymeric composition disposed in the butt joint in contact with the first end and the distal end.

Embodiment 8

The nonwoven abrasive belt of embodiment 7, wherein the adhesive polymeric composition comprises a storage modulus of at least $6.5\times10^6$ Pa to not greater than $9.9\times10^6$ Pa at a temperature of 150° C.

Embodiment 9

The nonwoven abrasive belt of embodiment 7, wherein adhesive polymeric composition comprises a polyurethane.

Embodiment 10

The nonwoven abrasive belt of embodiment 1, wherein the butt joint comprises the first end and the second end abutting each other, an adhesive polymeric composition disposed between the first distal end and the second distal end, a patch disposed on the second major surface opposite where the first distal end and the second distal end abut each other, and a layer of polymeric adhesive composition disposed between the patch and the second major surface.

Embodiment 11

The nonwoven abrasive belt of embodiment 10, wherein the adhesive polymeric composition comprises a seam of adhesive polymeric composition between the first distal end and the second distal end.

Embodiment 12

The nonwoven abrasive belt of embodiment 10, wherein the butt joint comprises an average thickness that is not less than 50% and not greater than 80% of an average thickness measured at a central location of the nonwoven abrasive belt, such as not less than 52% and not greater than 75%, not less than 54% and not greater than 70%, or not less than 56% and not greater than 65%.

Embodiment 13

The nonwoven abrasive belt of embodiment 10, wherein the butt joint further comprises a layer of adhesive polymeric composition disposed on the first major surface of the nonwoven web overlying the first distal end and the second distal end.

Embodiment 14

The nonwoven abrasive belt of embodiment 10, wherein the patch comprises a synthetic fabric, a polymeric film, or a combination thereof.

Embodiment 15

The nonwoven abrasive belt of embodiment 1, wherein the nonwoven abrasive web comprises an average weight of not less than 1500 g/m$^2$ and not greater than 2500 g/m$^2$.

Embodiment 16

The nonwoven abrasive belt of embodiment 1, wherein the nonwoven abrasive web comprises a web of lofty fibers, a polymeric binder composition disposed on the fibers, and abrasive particles disposed on and in the polymeric binder.

Embodiment 17

The nonwoven abrasive belt of embodiment 16, wherein the web of lofty fibers comprises a weight of not less than 180 g/m$^2$ and not greater than 250 g/m$^2$.

Embodiment 18

The nonwoven abrasive belt of embodiment 16, wherein the polymeric binder comprises a weight of not less than 500 g/m$^2$ to not greater than 900 g/m$^2$.

Embodiment 19

The nonwoven abrasive belt of embodiment 16, wherein the abrasive comprises a weight of not less than 400 g/m$^2$ to not greater than 1400 g/m$^2$.

Example 1

Figure 4:
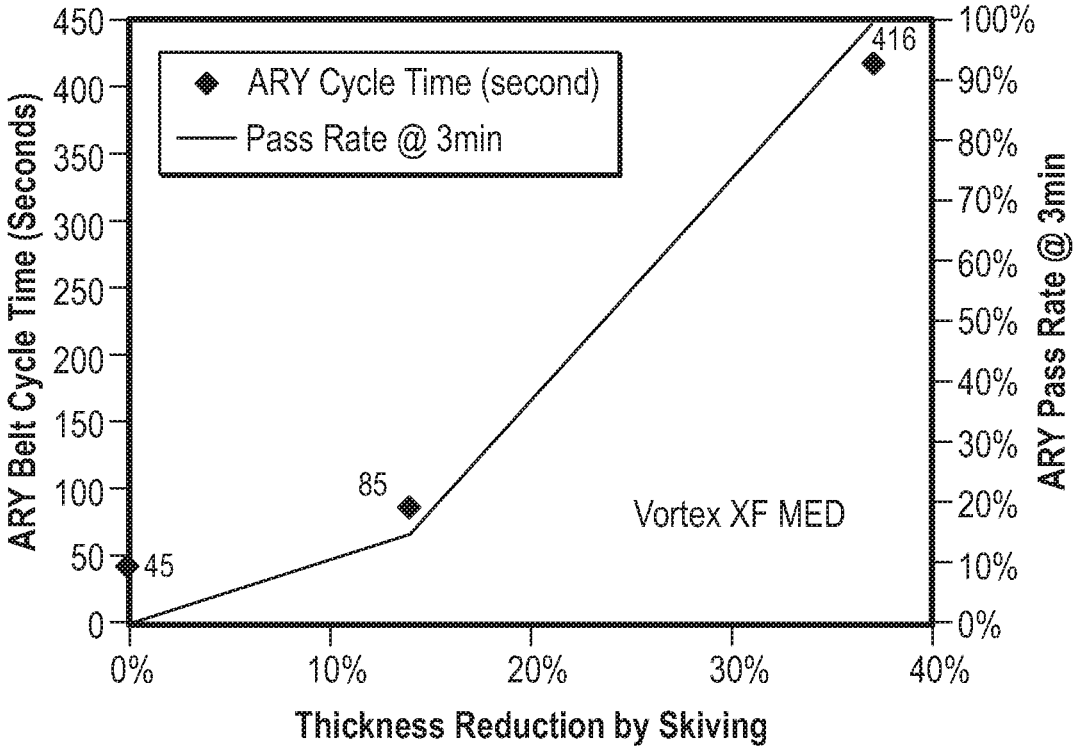
FIG. 4 shows a chart of belt cycle time and pass rate versus thickness reduction of an embodiment of a nonwoven abrasive belt embodiment including a flexible butt joint.
Figure 5:
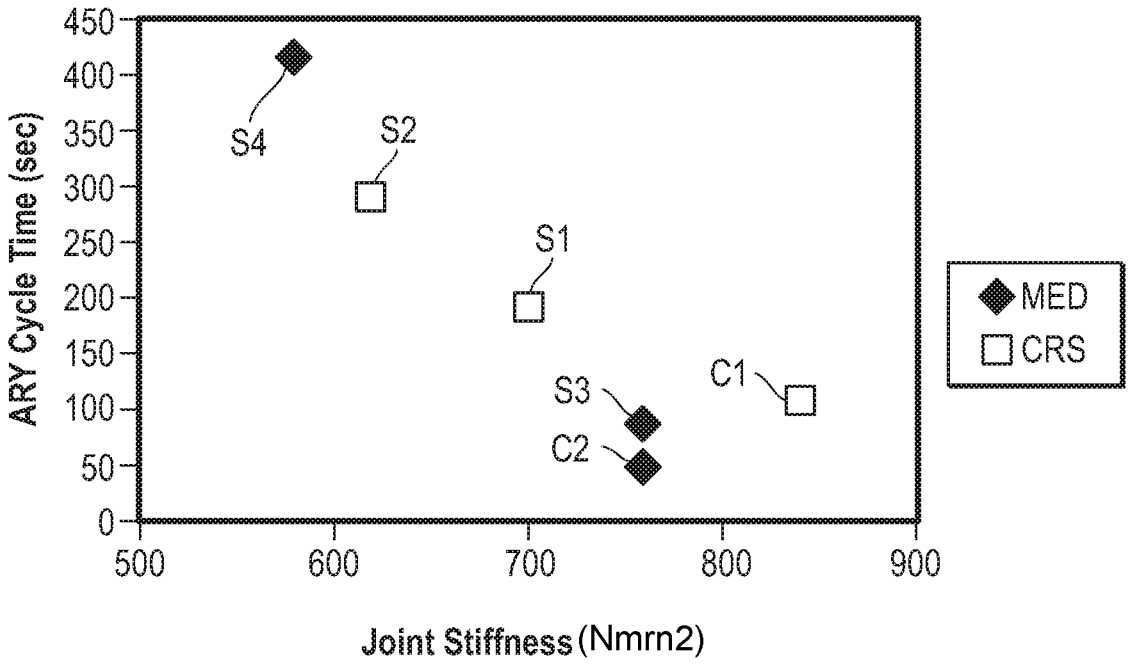
FIG. 5 shows a diagram of comparative data for belt cycle time versus joint stiffness for conventional nonwoven belts and nonwoven abrasive belt embodiments.

Sample nonwoven abrasive belts S3 and S4 were constructed as described herein and subjected abrasive performance testing (Belt Cycle Time) compared to a control nonwoven abrasive belt C2. The control belt was the same as the sample belts in all respects except as described herein. The results are shown in FIG. 4, FIG. 5, and the Table below.

| | Joint Type | Belt Thickness Reduction by Skiving | Joint Stiffness (MPa) | Cycle Time (sec) | Pass Rate at 180 sec (%) |
|---|---|---|---|---|---|
| C2 | Butt joint | 0% - No skiving | ~760 | 45 | 0 |
| S3 | Butt joint | 14% | ~750 | 85 | 15 |
| S4 | Butt joint | 37% | ~580 | 416 | 100 |

Average belt life (or cycle time) of non-skived belts was only 45 seconds, pass rate was 0% at 180 seconds. In contrast, the belt life was 416 seconds for belt S4 (100% pass rate) that had about a 37% thickness reduction through skiving.

Example 2

Sample nonwoven abrasive belts S1 and S2 were constructed as described herein and subjected to performance testing (Belt Cycle Time) compared to a control nonwoven abrasive belt C1. The control belt was the same as the sample belts in all respects except as described herein. The results are shown in FIG. 5 and the Table below.

| | Joint Type | Belt Thickness Reduction by Skiving | Joint Stiffness (MPa) | Cycle Time (sec) |
|---|---|---|---|---|
| C1 | Butt joint | 0% - No skiving | ~840 | 100 |
| S1 | Butt joint | 21% | ~700 | 190 |
| S2 | Butt joint | 38% | ~620 | 290 |

Average belt life (or cycle time) of non-skived belts was approximately 100 seconds, compared to approximately 290 seconds for belts that have about 21% thickness reduction through skiving.

Note that not all of the activities described above in the general description or the examples are required, that a portion of a specific activity may not be required, and that one or more further activities may be performed in addition to those described. Still further, the orders in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

What is claimed is:

1. A nonwoven abrasive belt comprising:

a nonwoven abrasive web having a first major surface, a second major surface, a first end, and a second end;

wherein the first end and the second end are adhered together by a butt joint, and wherein a portion of the first major surface of the first end or a portion of the first major surface of the second end includes a skived portion, wherein the butt joint comprises an average thickness that is not less the 50% and not greater than 80% of an average thickness measured at a central location of the nonwoven abrasive belt.

2. The nonwoven abrasive belt of claim 1, wherein a portion of the first major surface of the first end and a portion of the first major surface of the second end includes a skived portion.

3. The nonwoven abrasive belt of claim 1, wherein the butt joint comprises a stiffness of not greater than 1000 $N \cdot mm^2$.

4. The nonwoven abrasive belt of claim 1, wherein the butt joint comprises a stiffness of at least 300 $N \cdot mm^2$.

5. The nonwoven abrasive belt of claim 1, the nonwoven abrasive belt has a length of 18 inches, and wherein the butt joint comprises an adhesive polymeric composition in an amount of not less than 0.2 wt % and not greater than 1.82 wt % of the total weight of the nonwoven abrasive belt.

6. The nonwoven abrasive belt of claim 1, the nonwoven abrasive belt has a length of 18 inches, and wherein the butt joint comprises an adhesive polymeric composition, wherein the amount of the adhesive polymeric resin and the amount of the nonwoven abrasive web are present in a ratio (adhesive:web) of not less than 1:200 to greater than 1:50.

7. The nonwoven abrasive belt of claim 1, wherein the butt joint comprises an adhesive polymeric composition disposed in the butt joint in contact with the first end and the distal end.

8. The nonwoven abrasive belt of claim 7, wherein the adhesive polymeric composition comprises a storage modulus of at least $6.5 \times 10^6$ Pa to not greater than $9.9 \times 10^6$ Pa at a temperature of 150° C.

9. The nonwoven abrasive belt of claim 7, wherein adhesive polymeric composition comprises a polyurethane.

10. The nonwoven abrasive belt of claim 1, wherein the butt joint comprises the first end and the second end abutting each other, an adhesive polymeric composition disposed between the first distal end and the second distal end, a patch disposed on the second major surface opposite where the first distal end and the second distal end abut each other, and a layer of polymeric adhesive composition disposed between the patch and the second major surface.

11. The nonwoven abrasive belt of claim 10, wherein the adhesive polymeric composition comprises a seam of adhesive polymeric composition between the first distal end and the second distal end.

12. The nonwoven abrasive belt of claim 10, wherein the butt joint comprises an average thickness that is not less than 52% and not greater than 75%.

13. The nonwoven abrasive belt of claim 10, wherein the butt joint further comprises a layer of adhesive polymeric composition disposed on the first major surface of the nonwoven web overlying the first distal end and the second distal end.

14. The nonwoven abrasive belt of claim 10, wherein the patch comprises a synthetic fabric, a polymeric film, or a combination thereof.

15. The nonwoven abrasive belt of claim 1, wherein the nonwoven abrasive web comprises an average weight of not less than 1500 $g/m^2$ and not greater than 2500 $g/m^2$.

16. The nonwoven abrasive belt of claim 1, wherein the nonwoven abrasive web comprises a web of lofty fibers, a polymeric binder composition disposed on the fibers, and abrasive particles disposed on and in the polymeric binder.

17. The nonwoven abrasive belt of claim 16, wherein the web of lofty fibers comprises a weight of not less than 180 $g/m^2$ and not greater than 250 $g/m^2$.

18. The nonwoven abrasive belt of claim 16, wherein the polymeric binder comprises a weight of not less than 500 $g/m^2$ to not greater than 900 $g/m^2$.

19. The nonwoven abrasive belt of claim 16, wherein the abrasive comprises a weight of not less than 400 $g/m^2$ to not greater than 1400 $g/m^2$.

* * * * *